United States Patent [19]

Kato et al.

[11] Patent Number: 4,601,269

[45] Date of Patent: Jul. 22, 1986

[54] FUEL INJECTION NOZZLE

[75] Inventors: Masaaki Kato, Kariya; Shigeki Tojo, Mie; Kazuyoshi Arai, Toyota, all of Japan

[73] Assignee: Nippondenso Co., Ltd., Kariya, Japan

[21] Appl. No.: 748,397

[22] Filed: Jun. 24, 1985

[30] Foreign Application Priority Data

Jun. 27, 1984 [JP] Japan ..... 59-132346

[51] Int. Cl.[4] ..... F02M 59/34

[52] U.S. Cl. ..... 123/300; 123/446; 123/447; 239/88

[58] Field of Search ..... 123/446, 447, 299, 300; 239/88-95

[56] References Cited

U.S. PATENT DOCUMENTS

| | | | |
|---|---|---|---|
| 4,425,894 | 1/1984 | Kato et al. | 123/446 |
| 4,467,963 | 8/1984 | Sisson et al. | 239/90 |
| 4,537,352 | 8/1985 | Kato et al. | 123/446 |
| 4,541,385 | 9/1985 | Eheim et al. | 123/446 |

FOREIGN PATENT DOCUMENTS

| | | | |
|---|---|---|---|
| 3141547 | 5/1983 | Fed. Rep. of Germany | 123/446 |
| 57-151058 | 9/1982 | Japan . | |
| 222969 | 12/1983 | Japan | 123/446 |

*Primary Examiner*—Magdalen Y. C. Greenlief

*Attorney, Agent, or Firm*—Cushman, Darby & Cushman

[57] ABSTRACT

A fuel injection nozzle of this invention includes a nozzle housing which defines therein a fuel sump chamber, stepped cylinder bore and fuel passage connected at one end to the sump chamber and at the other end to a smaller diameter bore section of a stepped bore. A stepped plunger is fitted into the stepped cylinder bore to define a pump chamber communicating with the fuel passage and a main fuel chamber into which the main fuel is supplied from a fuel injection pump. An auxiliary fuel is supplied from a feed pump through the fuel passage into the sump chamber and pump chamber. A nozzle needle is located within the nozzle housing and is responsive to a fuel pressure within the sump chamber to cause it to be lifted to permit an injection hole to be opened. The nozzle needle is urged under a predetermined force of a pressure spring in a direction in which the injection hole is blocked. The urging force of the pressure spring is set to be greater than the pressure of the auxiliary fuel supplied from the feed pump and smaller than the pressure of the main fuel supplied from the fuel injection pump. The main fuel chamber, when the plunger is moved a predetermined distance responsive to the fuel pressure within the main fuel chamber, is permitted to be connected to the fuel passage.

9 Claims, 7 Drawing Figures

FUEL INJECTION NOZZLE

BACKGROUND OF THE INVENTION

This invention relates to a fuel injection nozzle for injecting fuel into a combustion chamber of an internal combustion engine and, in particular, to a fuel injection nozzle suited to a diesel engine.

Generally, a diesel engine is louder in combustion noises, and poorer in combustion efficiency, than a gasoline engine. Various attempts have so far been made to eliminate drawbacks inherent in the diesel engine. It is known in the art that, in order to reduce the combustion noises in the diesel engine, fuel is injected by a fuel injection nozzle into a combustion chamber of the engine with a fuel injection rate decreased in an initial phase of a fuel injection period and increased in a final phase of the fuel injection period. For the fuel injection nozzle having such a fuel injection rate it is possible to reduce the combustion noises and suppress a sharp temperature rise within the combustion chamber and thus reduce an amount of NOx in an exhaust gas.

The fuel injection nozzle having the above-mentioned fuel injection rate is disclosed, for example, in Japanese Patent Disclosure (KOKAI) No. 151058/82. The known fuel injection nozzle has a nozzle needle for permitting a fuel injection hole to be opened and closed. In the initial phase of the fuel injection period the lift of the nozzle needle is restricted to a predetermined amount of lift through the abutment of the nozzle needle against the spring-urged adjustment piston. As a result, the cross-sectional area of the opening of the injection hole is small in the initial phase of the fuel injection period so that the fuel injection rate is suppressed to a smaller extent. Thereafter, the nozzle needle is further lifted against an urging force of the spring with the adjustment piston so abutted, resulting in an increase in the opening area of the injection hole and thus an increase in the fuel injection rate in a final phase of the fuel injection period.

In order to enhance the combustion efficiency of fuel in the combustion chamber it is necessary to enhance the atomization of fuel injection at an initial phase of the fuel injection period and thus to ignite the fuel in a better condition. However, no adequate consideration is paid to this aspect, failing to adequately enhance the engine output.

SUMMARY OF THE INVENTION

It is accordingly the object of this invention to provide a fuel injection nozzle which can reduce combustion noises in an engine and can enhance the combustion efficiency of fuel.

The above-mentioned object can be attained by the fuel injection nozzle of this invention. The fuel injection nozzle includes a nozzle housing which defines therein a fuel sump chamber, an injection hole communicating with the sump chamber and opening into an outside, and a stepped cylinder bore having smaller and larger diameter bore section. A fuel passage is further formed in the nozzle housing. One end of the fuel passage is connected to the fuel sump chamber, the other end of the fuel passage is connected to an auxiliary fuel supply source. The auxiliary fuel supply source supplies through the fuel passage into the sump chamber, fuel which is lower in pressure than fuel which is delivered from a fuel injection pump. A needle valve for opening and closing the fuel injection hole is disposed within the nozzle housing. The needle valve, when the fuel pressure within the sump chamber exceeds a predetermined pressure level, that is, a valve opening pressure, opens the fuel injection hole to permit the fuel in the sump chamber to be injected from the fuel injection hole, noting that the valve opening pressure is set to be greater than the pressure of fuel supplied from the auxiliary fuel supply source. A stepped plunger is fitted into the stepped cylinder bore of the nozzle housing. The stepped plunger comprises a larger diameter plunger section fitted into a larger diameter bore section of the cylinder bore and a smaller diameter plunger section fitted into the smaller diameter bore section. The cylinder bore, together with the end face of the larger diameter plunger section, defines therein a main fuel chamber into which fuel higher in pressure than the valve opening pressure of the fuel from the fuel injection pump is supplied. A pump chamber is defined in the cylinder bore by the end face of the small diameter plunger section and is connected to the fuel passage to permit the fuel from the auxiliary fuel supply source to be supplied into the pump chamber. When the stepped plunger is moved a predetermined distance, under the pressure of the fuel into the main fuel chamber, in a direction in which the stepped plunger pressurizes the fuel in the pump chamber, a communication means permits the main fuel chamber to communicate with the fuel sump chamber.

According to the fuel injection nozzle, when the higher pressure fuel is supplied from the fuel injection pump into the main fuel chamber, the stepped plunger is moved in a direction in which the volume of the pump chamber is decreased, pressurizing the fuel in the pump chamber. As a result, the fuel pressure in the fuel passage leading to the pump chamber and in the sump chamber are increased. When the fuel pressure in the sump chamber exceeds the valve opening pressure, the injection hole is opened by the needle valve, causing the fuel in the sump chamber to be injected. In this way, the fuel pre-injection is started. Since, in this case, the amount of fuel injected from the injection hole corresponds to the amount of fuel pumped from the pump chamber by the smaller diameter plunger section, a smaller amount of fuel is injected from the injection hole and thus the fuel injection rate can be restricted to a smaller extent. Since the fuel in the pump chamber is pressurized to A1/A2 times the pressure of the main fuel chamber with A1 and A2 representing the cross-sections of the larger and smaller diameter plunger sections, respectively, it is possible to enhance the fuel injection pressure. For this reason, it is possible to assure an effective fuel atomization in the fuel pre-ignition phase of a fuel injection period and thus enhance the fuel ignitability.

The further movement of the stepped plunger and the consequent communication of the main fuel chamber with the fuel passage through the above-mentioned communication means permit the high pressure fuel in the main fuel chamber to be supplied into the sump chamber through the fuel passage. If this is done, the needle valve is wide opened under the high pressure fuel of the sump chamber, permitting the main fuel injection to be started in the final phase of the fuel injection period. At the main fuel injection time, the fuel in the main fuel chamber is supplied directly to the fuel sump chamber, causing the fuel to be injected from the injection hole to permit the fuel injection rate to be abruptly increased as compared with the pre-injection phase of the fuel injection period.

DETAILED DESCRIPTION OF THE PREFERRED EMBODIMENTS

Figure 1:
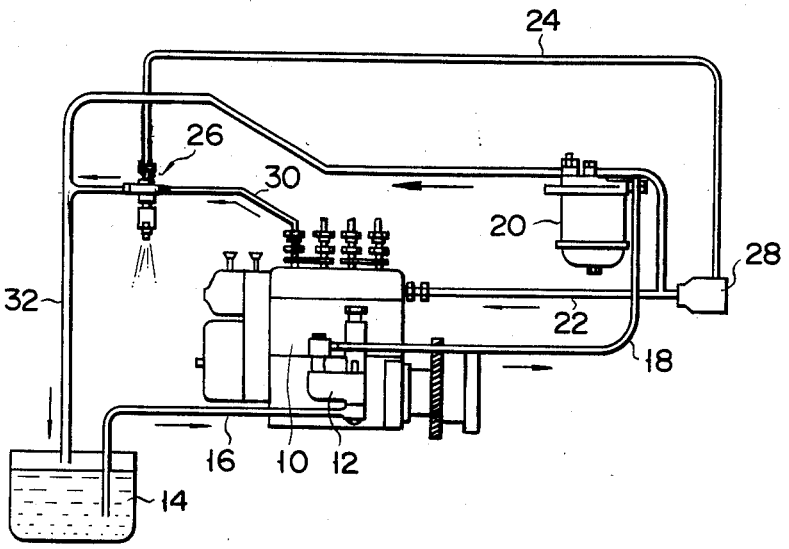
FIG. 1 is a diagrammatic view showing a fuel injection system including a fuel injection nozzle of this invention.

FIG. 1 is a diagrammatical view showing a fuel injection system including a fuel injection nozzle of this invention. The fuel injection system includes a fuel injection pump 10 of a duel-in line type having a feed pump 12. These pumps 10 and 12 are driven by an engine not shown. The feed pump 12 is connected at a suction side to a fuel tank 14 through a suction pipe 16 and at a discharge end to a filter 20 through a supply pipe 18. A fuel supply pipe 22 extending from the filter 20 is connected to the fuel injection pump 10. A branch pipe 24 which is branched from the fuel supply pipe 22 is connected to a fuel injection nozzle 26 as will be set out in more detail. A pulsation damper 28, which damps the pulsation of the fuel, is disposed partway of the branched pipe 24.

A fuel delivery valve of the fuel injection pump 10 is connected to the fuel injection nozzle 26 through a fuel-delivery pipe 30. The filter 20 and fuel injection nozzle 26 are coupled to the fuel tank 14 through a return pipe 32. In FIG. 1, only one fuel injection nozzle 26 is shown, but, needless to say, a plurality of fuel injection nozzle 26 equal in number to engine cylinders are connected to the fuel injection pump 10.

Figure 2:
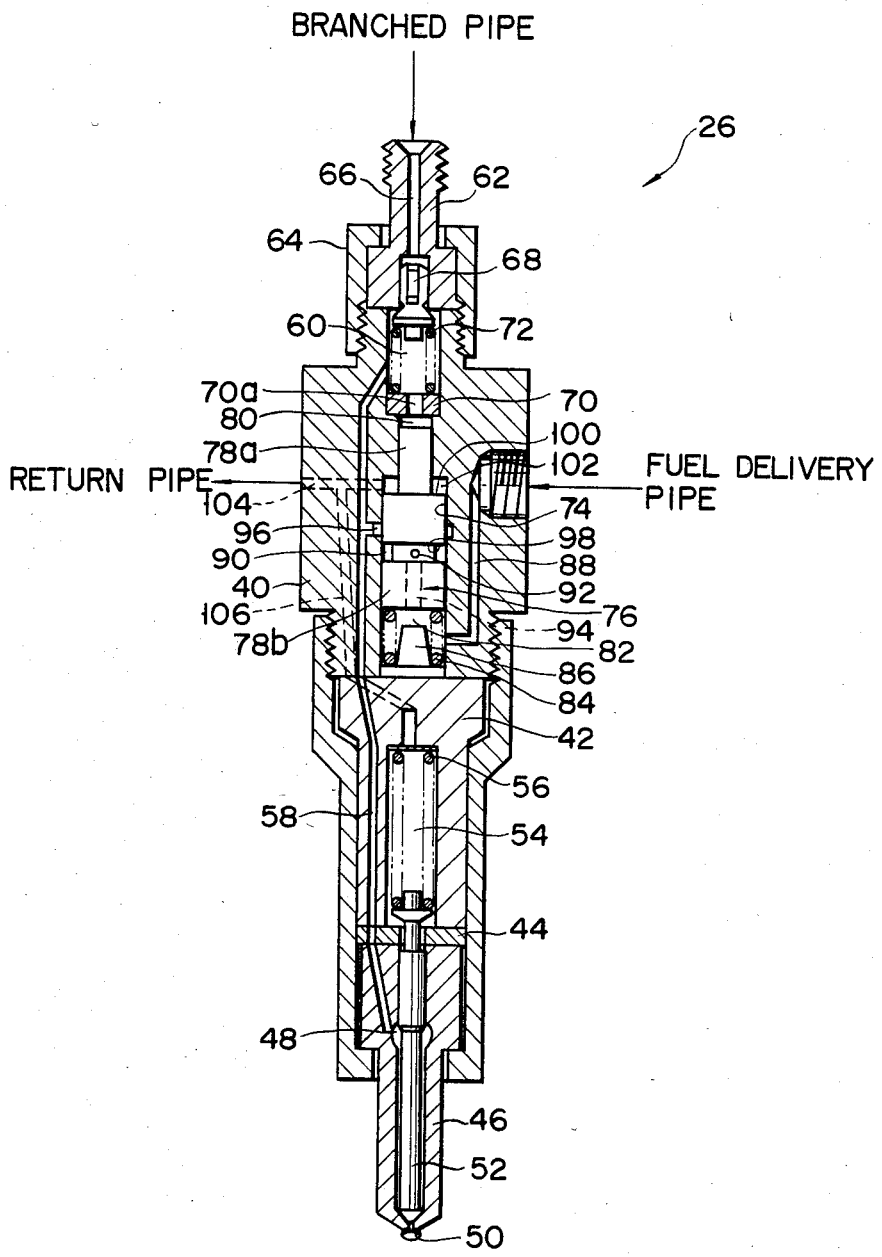
FIG. 2 is a cross-sectional view showing the fuel injection nozzle according to one embodiment of this invention.

FIG. 2 shows in detail a general arrangement of the fuel injection nozzle 26. The nozzle 26 includes a nozzle cylinder 40. Below the nozzle cylinder 40, a nozzle holder 42, a tip packing 44 and nozzle body 46 are located in this order. These members 40, 42, 44 and 46 are coaxially coupled together by means of a retaining nut 47.

A fuel sump chamber 48 is defined within the nozzle body 46 and a injection hole 50 is formed at the tip end of the nozzle body 46 to communicate with the sump chamber 48. A nozzle needle 52 for opening and closing the injection hole 50 is coaxially arranged within the nozzle body 46 and is axially slidable there. In FIG. 2, the upper end of the nozzle needle 52 extends through the tip packing 44 into a spring chamber 54 which is defined within the nozzle holder 42. A pressure coil spring 56 is housed within the spring chamber 54. The lower end of the coil spring 56 abuts against a flange **52*a* which is formed at the upper end of the nozzle needle 52. This permits the nozzle needle 52 to be urged with a predetermined pressure in the down direction in which the injection hole 50 is closed. One end of a fuel passage 58 communicates with the sump chamber 48 of the nozzle body 46, noting that the fuel passage 58 constitutes a continuous passage extending through the nozzle body 46, tip packing 44, nozzle holder 42 and nozzle cylinder 40. The other end of the fuel passage 58 communicates with a chamber 60 which is formed within the upper end portion of the nozzle cylinder 40. A check valve holder 62 is connected to the upper end of the nozzle cylinder 40 through a nut 64. An interior passage 66 formed in the check valve holder 62 communicates at one end with the chamber 60 and at the other end with the branch pipe 24 and thus the feed pump 12. A check valve 68 is slidably fitted in one end portion of the interior passage 66 to block that port of the interior passage 66 which is opened into the chamber 60. A shim 70 is disposed in the inner end surface of the chamber 60 which is remote from a check valve 68. Within the chamber 60 a coil spring 72 is disposed between the shim 70 and the check valve 68. The check valve 68 is urged under a predetermined pressure in a direction in which the interior passage 66 is blocked. The urging force of the coil spring 72, that is, the valve opening pressure of the check valve 68 can be adjusted by varying the thickness of the shim 70. The valve opening pressure of the check valve 68 determined by the coil spring 72 is set to be smaller than the pressure of the fuel supplied from the feed pump 12. However, the valve opening pressure of the nozzle needle 52 determined by the pressure coil spring 56 is set to be greater than the pressure of the fuel which is supplied from the feed pump 12. A stepped cylinder bore 74 communicating with the chamber 60 through a hole 70a is coaxially formed within the nozzle cylinder 40. The cylinder bore 74 comprises a smaller diameter bore section cummunicating with the chamber 60 and a layer diameter bore section formed on the side of the nozzle holder 42. A stepped plunger 76 is fitted into the cylinder bore 74. The stepped plunger 76 comprises a smaller diameter section 78*a* fitted into the smaller bore section and a larger diameter section 78*b* fitted into the larger diameter bore section of the cylinder bore. A pump chamber 80 is defined by the end face of the smaller diameter section 78*a* within the smaller diameter bore section. Within the larger diameter bore section a main fuel chamber 82 is defined between the end face of the larger diameter section 78*b* and upper end face of the nozzle holder 42. An adjusting spring 84 is held within the main fuel chamber 82 and the plunger 76 is upwardly urged under the force of the adjusting spring 84 as seen from FIG. 2. Within the main fuel chamber 82 a stopper 86 is disposed which regulates a downward movement of the plunger 76**.

The main fuel chamber 82 communicates with the fuel delivery pipe 30 through a fuel feed passage 88 which is formed in the nozzle cylinder 40. An annular groove 90 is formed on the larger diameter section **78*b* of the plunger 76. The annular groove 90 communicates with the main fuel chamber 82 through a radial hole 92 and axial hole 94 of the larger diameter section 78*b* of the plunger 76. A main injection port 96 as an annular groove is firmed in the inner surface of the larger diameter bore section of the cylinder bore 74 and the main injection port 96 can be opened and closed by an lead 98 which defines the annular groove 90. The main injection port 96 communicates with the fuel passage 58**.

An annular surface 100 is formed at a boundary between the smaller diameter section **78*a* and larger diameter section 78*b* of the stepped plunger 76 to define a chamber 102. The chamber 102 communicates with the above-mentioned return pipe 32 through a return passage 104 of the nozzle cylinder 40. The spring chamber 54 communicates with the return passage 104 through a passage 106 extending from the spring chamber 54 to the return passage 104**.

The operation of the fuel injection nozzle 26 will now be explained below by referring to FIGS. 3 and 4.

When the feed pump 12 is driven by an engine, it permits a fuel in the fuel tank 14 to be supplied to the branch pipe 24 through the filter 20 and damper 28 and to the fuel injection pump 10. The pressure of the fuel which is supplied from the feed pump 12 is in proportion with the number of rotations of the engine.

When the fuel from the feed pump 12 is supplied into the branch pipe 24, the check valve 68 is lifted against the urging force of the coil spring 72 to permit the interior passage 66 of the check valve holder 62 to be opened. In consequence, the fuel in the branch pipe 24 is introduced into the sump chamber 48 through the interior passage 66, chamber 60 and fuel passage 58. Since at this time the fuel pressure in the sump chamber 48 is smaller than the valve opening pressure of the nozzle needle 52, the nozzle needle 52 is not lifted against the urging force of the pressure coil spring 56 and thus the injection hole 50 remains closed.

On the other hand, a part of the fuel which is introduced into the chamber 60 is introduced through the hole 70*a* of the shim 70 into the pump chamber 80 where the pressure in the pump chamber 80 rises. As a result, the plunger 76 is moved downward against the urging force of the coil spring 84 in which case the plunger 76 is held in a position in which the fuel pressure acting upon the end face of the smaller diameter section 78*a* of the plunger 76 is in equilibrium with the force of the coil spring 84.

In this case, when a high pressure fuel is introduced from the fuel injection pump 10 through the fuel pumping pipe 30 and fuel introduction passage, the fuel pressure in the main fuel chamber 82 acts upon the end face of the larger diameter section 78*b* of the plunger 76. In consequence, the plunger 76 is moved upward in FIG. 2, resulting in a rise in the fuel pressure in the pump chamber 80. Suppose that A1 denotes the area of the end face of the larger diameter section 78 facing the main fuel chamber 82 and that A2 denotes the area of the end face of the smaller diameter section facing the pump chamber 80. In this case, the fuel in the pump chamber 80 is pressurized to A1/A2 times the high pressure fuel level in the main fuel chamber 82. The pressure in the pressurized pump chamber 80 is transmitted through the fuel passage 58 into the sump chamber 48. The pressure in the sump chamber 48 starts to rise from a point of time, $\alpha 1$, as indicated by the solid line in FIG. 3, noting that in FIG. 3 the abscissa shows a crank angle of the engine and the ordinate shows the fuel pressure in the sump chamber 48. As shown in FIG. 3, when the pressure in the sump chamber 48 exceeds a valve opening pressure Po of the nozzle needle 52, the nozzle needle 52 is lifted against the urging force of the pressure coil spring 56. As a result, the injection hole 50 of the fuel injection nozzle is opened at a point of time corresponding to the crank angle $\alpha 2$, thus starting the pre-injection of the fuel. Immediately after the injection hole 50 has been opened with the lift of the plunger 76, the fuel pressure in the sump chamber 48 somewhat falls temporarily as shown in FIG. 3 and then continues to rise. When, at a point of time corresponding to the crank angle $\alpha 3$, the main injection port 96 is opened through the lead 98 with the lift of the plunger 76, the main fuel chamber 82 is linked to the fuel passage 58 through the axial hole 94, radial hole 92, annular groove 90 and main injection port 96. That is, immediately after the main injection port 96 has been opened, at the point of time corresponding to the crank angle $\alpha 3$, due to the communication made between the main injection chamber 82 and the sump chamber 48, the fuel pressure in the sump chamber 48 somewhat falls temporarily as shown in FIG. 3 and then continues to rise. As a result, the nozzle needle 52 is further lifted against the urging force of the pressure coil spring 56 to permit the injection hole 50 to be further opened. As a result, the fuel supplied into the main injection chamber 82 is injected from the injection hole 50 through the sump chamber 48, starting a main injection of fuel. With the plunger 76 further lifted, the end of the smaller diameter section 78*a* of the plunger 76 abuts against the shim 70, thereby suppressing the further lifting of the plunger 76 under the action of the coil spring 72. Then, the annular surface 100 of the plunger 76 abuts against the stepped portion of the cylinder bore, thereby stopping the further lifting of the plunger 76. When a supply of the high pressure fuel into the main fuel chamber 82 from the fuel injection pump 10 is stopped, the fuel pressure in the main fuel chamber 82 is lowered. As a result, the fuel pressure in the sump chamber 48 is also lowered and, when at the point of time corresponding to the crank angle $\alpha 4$ the fuel pressure in the sump chamber 48 falls down to the valve closing pressure p1 of the nozzle needle 52, the nozzle needle 52 falls under the action of the pressure coil spring 56, causing the injection hole 50 to be closed by the nozzle needle 52 and thus ending the main injection of the fuel.

With the fall of the fuel pressure in the main fuel chamber 82, the plunger 76 is pressed down under a residual pressure in the pump chamber 80 and under the action of the coil spring 72. After the main injection port 96 is re-closed by the lead 98, the plunger 76 is returned to an initial position. The falling of the plunger 76 causes an increase in the volume of the pump chamber 80 and thus a further fall in the fuel pressure in the pump chamber 80 and thus the sump chamber 48.

In this way, the fuel injection nozzle is operated in the above-mentioned cycle. From FIG. 3 it will be appreciated that at a time period T1 corresponding to the crank angle $\alpha 2$ to $\alpha 3$ the pre-injection of the fuel is performed and at a time period T2 corresponding to the crank angle $\alpha 3$ to $\alpha 4$ the main injection of the fuel is carried out.

Figure 3:
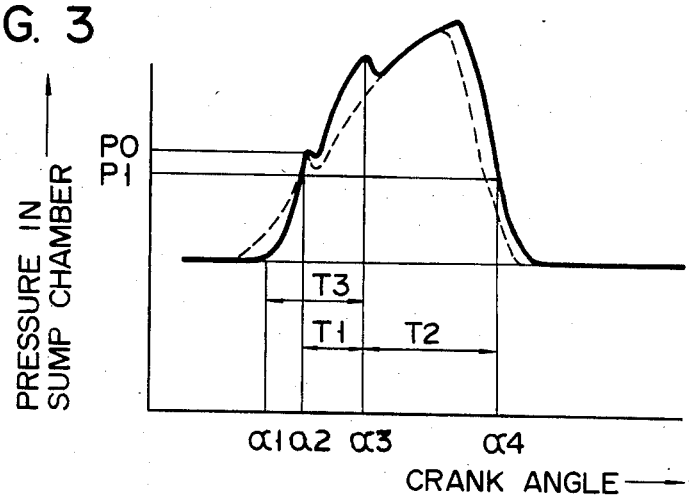
FIG. 3 is a view showing a pressure variation in a fuel sump chamber in the fuel injection nozzle of FIG. 2.
Figure 4:
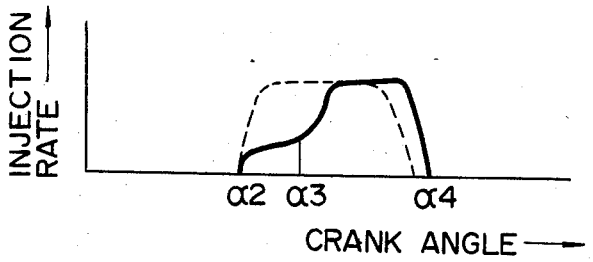
FIG. 4 is a view showing the characteristic for a fuel injection rate of the fuel injection nozzle of FIG. 2.

In the fuel injection nozzle according to one embodiment of this embodiment, as shown in FIG. 3, the fuel in the pump chamber 80 is pressurized by the plunger 76 to permit the pre-injection of the fuel. Since, therefore, during the fuel pre-injection period T1 the pressure of the fuel injected can be increased above the valve opening presure of the nozzle needle 52, thus assuring a better atomization fuel pattern. It is also possible to enhance the ignitability of the fuel and thus combustion efficiency of the fuel. The amount of fuel injected during the fuel pre-injection period T1 is equal to the extent to which the smaller diameter section 78*a* of the plunger 76 moves into the pump chamber 80, allowing the amount of fuel injected during the period T1 to be suppressed to a low level. In other words, during the fuel pre-injection period T1, that is, at the initial phase of the fuel injection period the fuel injection rate can be suppressed to the low level. During the main fuel injection time T2, that is, at the final phase of the fuel injection period the fuel in the main fuel chamber 82 is injected from the injection hole 50 through the fuel passage 58 and sump chamber 48 so that the fuel injection rate is increased over the fuel injection rate of the pre-injection time. Thus, the fuel injection nozzle of this invention has an injection rate characteristic as indicated by the solid line in FIG. 4, noting that in the graphs of FIGS. 3 and 4 the broken line shows a relation of the fuel injection rate characteristic to the pressure variation in the sump chamber of a conventional fuel injection nozzle.

Figure 5:
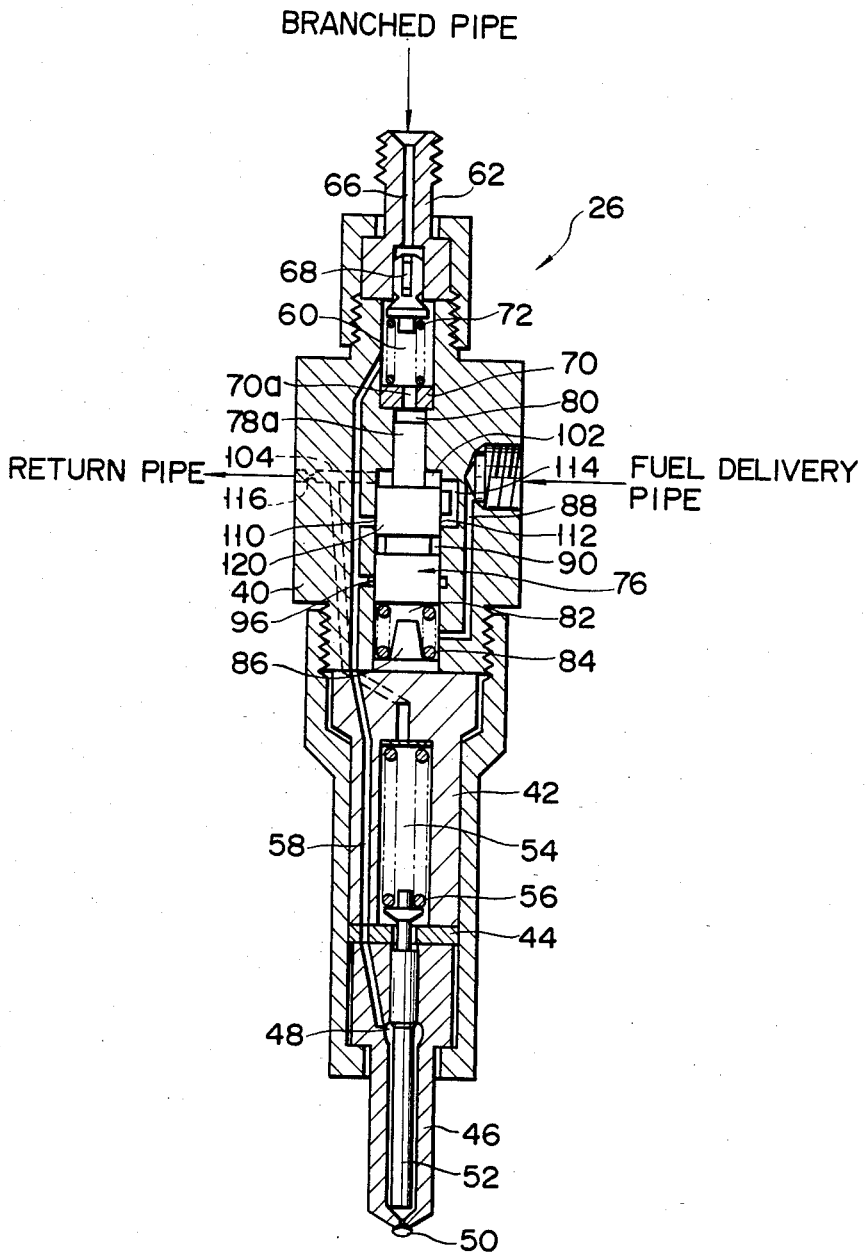
FIG. 5 is a cross-sectional view showing a fuel injection nozzle according to another embodiment of this invention.

This invention is not restricted to the above-mentioned embodiment. FIG. 5 is a view showing a fuel injection nozzle according to another embodiment of this invention, noting that the fuel injection nozzle is basically similar in structure to the fuel injection nozzle of FIG. 2. In the arrangement of FIG. 5, like references numerals are employed to designate parts or elements corresponding to those shown in FIG. 2. Therefore, any further explanation will be omitted except for parts of elements different from those in FIG. 2.

In the fuel injection nozzle of FIG. 5, the following means is adapted in place of the radial hole 92 and axial hole 94. In the inner surface of a stepped cylinder bore a pilot port 110 is opened in the neighborhood of a main injection port 96 in the fuel injection nozzle. The pilot port 110 is communicated with a fuel passage 58 and a return port 112 is opened on the inner side of the stepped cylinder bore such that it is located opposite to the pilot port 100. The return port 112 can communicate with a chamber 102 through a passage 114. The pilot port 110 permits the communication to be made with, and shut off against, the return port 112 through a lead 120 defined by an annular groove 90. A constriction 116 is provided partway of a return passage 104. In the fuel injection nozzle of FIG. 5 the main injection port 96 is opened in a position lower than at a level of the pilot port 110 and opened and closed by a lead surface 98, i.e., the end face of the larger diameter section **78*b* of the plunger 76**.

According to the fuel injection nozzle of FIG. 5, when the stepped plunger 76 is lifted by the fuel pressure in the main fuel chamber 82 as in the fuel injection nozzle of FIG. 2, the fuel pre-injection is started. The communication of the pilot port 110 with the return port 112 through the lead 120 permits the bypassing of the fuel in the fuel passage 58 through the pilot port 110, annular groove 90, return port 112, passage 114, chamber 102 and return passage 104. As a result, the fuel pressure in a sump chamber 48 falls, causing a nozzle needle 52 to be moved downward to close an injection hole 50 temporarily. In this time, the fuel pre-injection is ended. In this connection it is to be noted that the constriction 116 on the return passage 104 prevents an excessive fall in the fuel pressure in the sump chamber 48.

When the return port 112 is closed by an annular surface 100 of the larger diameter section **78*b* with the further lifting of the plunger 76, the fuel in the sump chamber 48 starts to be re-pressurized. Further lifting of the plunger 76 causes the main injection port 96 to be opened through the lead 98, starting the main injection as in the case of the fuel injection nozzle of FIG. 2**.

According to the fuel injection nozzle of FIG. 5, the pre-injection and main injection are not effected in a continuous fashion, noting that the pre-injection corresponds to the pilot injection. In the fuel injection nozzle of FIG. 5, if two different kinds of fuel are supplied one to the pump chamber 80 and one to main fuel chamber 82, then it is possible to apply the fuel injection nozzle to the so-called dual fuel injection type.

Figure 6:
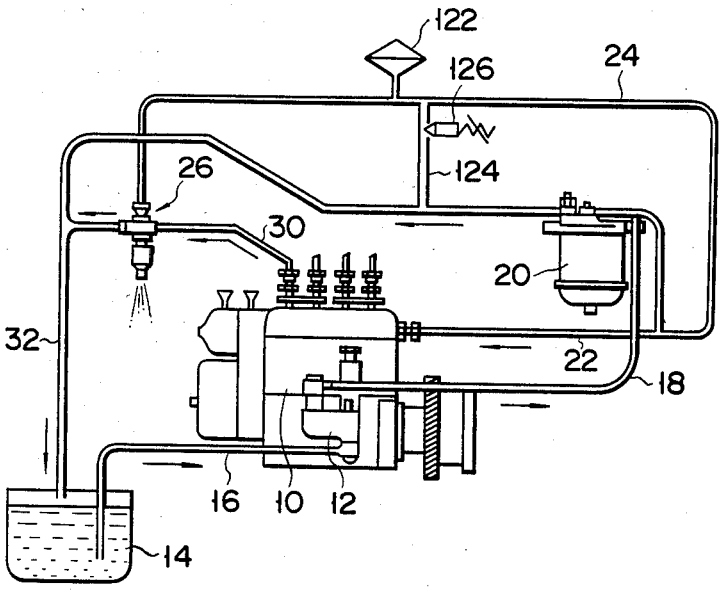
FIGS. 6 and 7 are diagrammatic views each showing a modified form of the fuel injection system.

FIG. 6 shows a modified form of the fuel injection system shown in FIG. 1. In the system of FIG. 6 an accumulator 122 are used in place of the pulsation damper 28 of FIG. 1 and a communication pipe 124 communicates with a return pipe 32 through a communication pipe 124. The pipe 124 has a constriction 126 for adjusting the cross-sectional area of the passage of the communication pipe 124. In the fuel injection system of FIG. 6, the cross-sectional area of the passage 124 is adjusted by the constriction 126, thus adjusting an amount of fuel which is supplied into the pump chamber 80 of the fuel injection nozzle. That is, it is possible to control the amount of fuel by the constriction 126 during the pre-injection period.

Figure 7:
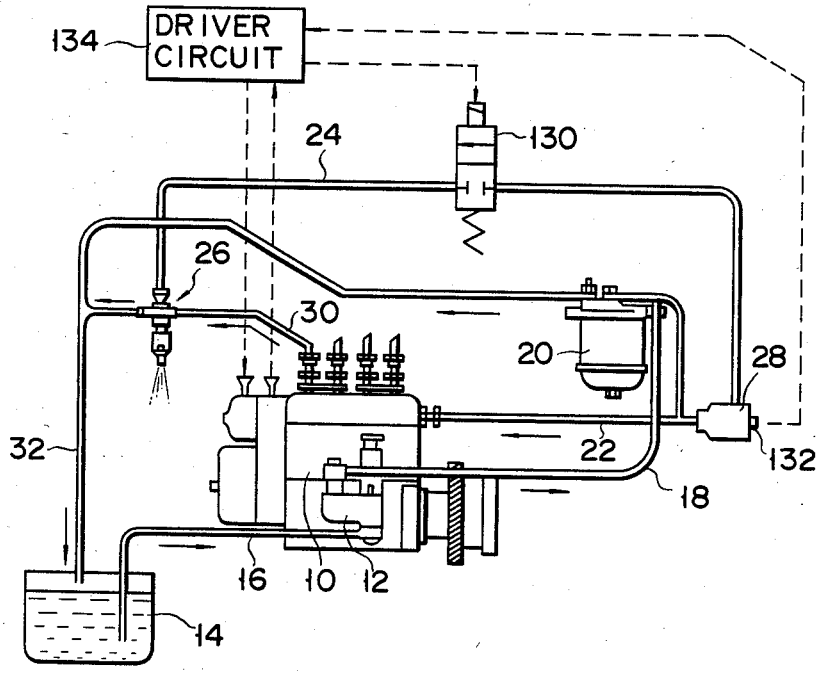

FIG. 7 shows another modified form of the fuel injection system. In the arrangement shown in FIG. 7, a electromagnetically actuating valve is disposed in a branch pipe 24 to permit it to be opened and closed. A pressure sensor 132 is arranged on a pulsation damper 28 to detect the fuel pressure in the branch pipe 28. A signal from the pressure sensor 132 is supplied to a driver circuit 134 of the valve 130 and the driven circuit 134 controls the operation of the valve 130 on the basis of the signal of the pressure sensor 132. Even in the system shown in FIG. 7 it is possible to control the amount of fuel supplied into a pump 80, that is, the amount of fuel pre-injected.

What is claimed is:

1. A fuel injection nozzle connected to a fuel injection pump to inject fuel into a combustion chamber of an internal combustion engine, comprising:

a nozzle housing defining therein a fuel sump chamber, an injection hole communicating with the sump chamber and opened at the outer surface of the nozzle housing, a stepped cylinder bore having a smaller diameter bore section and a larger diameter bore section and a fuel passage communicating at one end with the sump chamber and at the other end with the smaller diameter bore section of the stepped cylinder bore;

a stepped plunger fitted in the stepped cylinder bore and having a smaller diameter plunger section fitted into the smaller diameter bore section and a larger diameter plunger section fitted into the larger diameter bore section in which the smaller diameter bore section together with the end face of the smaller diameter plunger section defines a pump chamber communicating with the fuel passage and the larger diameter bore section together with the end face of the larger diameter plunger section defines a main fuel chamber into which a main fuel is supplied from the fuel injection pump;

auxiliary fuel supply means for supplying an auxiliary fuel into the sump chamber and pump chamber through the fuel passage;

valve means for opening and closing an injection hole, the valve means including a nozzle needle slidably disposed within the nozzle housing and responsive to a fuel pressure in the sump chamber to cause it to be lifted to permit the injection hole to be opened and a pressure spring for urging the nozzle needle under a predetermined force in a direction in which the injection hole is blocked, the urging force of the pressure spring being set to be greater than the pressure of the auxiliary fuel supplied from the auxiliary fuel supply means and smaller than the pressure of the main fuel supplied from the fuel injection pump; and communication means for permitting the main fuel chamber to communicate with the fuel passage when the main fuel is supplied from the injection pump into the main fuel chamber to cause the stepped plunger to be moved a predetermined distance in a direction in which the auxiliary fuel in the pump chamber is pressurized.

2. A fuel injection nozzle according to claim 1, in which the auxiliary fuel supply means comprises an auxiliary passage defined in the nozzle housing, the auxiliary passage being connected at one end to the fuel passage and opened at the other end on the nozzle housing, a feed pump connected to the other end of the auxiliary passage through an auxiliary fuel pipe to supply the auxiliary fuel and a check valve provided in the auxiliary passage to prevent a counterflow of the auxiliary fuel.

3. A fuel injection nozzle according to claim 2, in which the auxiliary fuel supply means further includes a pulsation damper provided in the auxiliary fuel pipe to damp the pulsation of the fuel which is supplied through the auxiliary fuel pipe.

4. A fuel injection nozzle according to claim 2, in which the auxiliary fuel supply means further includes an accumulator provided in the auxiliary fuel pipe adapted to damp the pulsation of the fuel which is supplied through the auxiliary fuel pipe, a bypass connected to the auxiliary fuel pipe to permit the auxiliary fuel in the auxiliary fuel pipe to be bypassed to a low pressure side, and a constriction provided at the bypass to permit the cross-sectional area of the bypass to be varied whereby an amount of auxiliary fuel supplied to the pump chamber is adjusted.

5. A fuel injection nozzle according to claim 2, in which the auxiliary fuel supply means further includes an electromagnetically actuable valve provided in the auxiliary fuel pipe to open and close the auxiliary fuel pipe, a pressure sensor for detecting the pressure of the auxiliary fuel flowing through the auxiliary fuel pipe, and an open/close valve driver circuit responsive to a signal from the pressure sensor to control the open time of the open/close valve whereby an amount of auxiliary fuel supplied to the pump chamber is adjusted.

6. A fuel injection nozzle according to claim 1, in which the communication means includes an annular groove formed on the outer peripheral surface of the larger diameter section of the stepped plunger, a passage formed within the stepped plunger to permit a communication to be made between the annular groove and the main fuel chamber, a main injection port opened at the inner surface of the larger diameter bore section of the stepped cylinder bore and communicating with the fuel passage, the main injection port being opened and closed by one edge of the annular groove.

7. A fuel injection nozzle according to claim 1, in which the communication means includes a main injection port opened at the inner surface of the larger diameter bore section of the stepped cylinder bore, the main injection port being opened and closed by the end face of the larger diameter section of the stepped plunger.

8. A fuel injection nozzle according to claim 7, in which the communication means includes an annular groove formed on the outer peripheral surface of the larger diameter section of the stepped plunger; a pilot port opened at the inner surface of the larger diameter bore section of the stepped cylinder bore; a bypass port opened at the inner peripheral surface of the larger diameter bore section of the stepped cylinder bore in a manner opposite to the pilot port, the pilot port and bypass port being opened before the main injection port is opened; a first bypass passage formed in the nozzle housing and connected at one end to the bypass port and opened at the other end into a bypass chamber defined between the inner surface of the larger diameter bore section of the cylinder bore and an annular surface formed at a boundary between the larger and smaller diameter sections of the stepped plunger, the other end of the first bypass passage being opened after the pilot port and bypass port have been opened by the edge of the annular surface but before the main injection port is opened; and a second bypass passage for connecting the bypass chamber to a lower pressure side.

9. A fuel injection nozzle according to claim 8, in which the communication means includes a constriction provided at the second bypass passage to reduce the cross-sectional area of the second bypass passage.

* * * * *